US006099446A

United States Patent [19]

Johnson et al.

[11] Patent Number: 6,099,446

[45] Date of Patent: Aug. 8, 2000

[54] EXERCISE APPARATUS UTILIZING ELASTIC STRAPS

[76] Inventors: Derrick Johnson, 124 Cityview Ave., Bridgeport, Conn. 06606; Orlando Almedina, 877 Hallett St., Bridgeport, Conn. 06608

[21] Appl. No.: 09/150,588

[22] Filed: Sep. 10, 1998

[51] Int. Cl.[7] ..... A63B 21/02

[52] U.S. Cl. ..... 482/124

[58] Field of Search ..... 482/124

[56] References Cited

U.S. PATENT DOCUMENTS

| | | | |
|---|---|---|---|
| 5,518,480 | 5/1996 | Frappier | 482/124 |
| 5,683,336 | 11/1997 | Pape | 482/124 |
| 5,716,307 | 2/1998 | Vadher | 482/125 |
| 5,752,900 | 5/1998 | Holland, Jr. | 482/124 |

*Primary Examiner*—Richard J. Apley
*Assistant Examiner*—Lori Baker

[57] ABSTRACT

A new exercise apparatus utilizing elastic straps for providing resistance to muscles of the body. The inventive device includes a body harness that is adapted for extending across a back and a pair of shoulders of a user. The body harness has a T-shaped portion to help hold the body harness in place. The T-shaped portion is adapted for extending downwardly from the body harness along the back of the user. The T-shaped portion having a pair of horizontal torso straps which are adapted for adjustable extension around the torso of a user. A set of arm bands has a pair of upper arm bands and a pair of wrist bands. The upper arm bands and the wrist bands are connected by a plurality of resiliently elastic arm resistance straps. The pair of upper arm bands is coupled to the body harness. Each of the upper arm bands is adapted for adjustably wrapping around an upper arm towards a shoulder of the user. The pair of wrist bands are adapted for extension around wrists of the user.

18 Claims, 3 Drawing Sheets

EXERCISE APPARATUS UTILIZING ELASTIC STRAPS

BACKGROUND OF THE INVENTION

1. Field of the Invention

The present invention relates to exercise apparatuses and more particularly pertains to a new exercise apparatus utilizing elastic straps for providing resistance to muscles of the body.

2. Description of the Prior Art

The use of exercise apparatuses is known in the prior art. More specifically, exercise apparatuses heretofore devised and utilized are known to consist basically of familiar, expected and obvious structural configurations, notwithstanding the myriad of designs encompassed by the crowded prior art which have been developed for the fulfillment of countless objectives and requirements.

Known prior art exercise apparatuses include U.S. Pat. No. 4,961,573; U.S. Pat. No. 5,505,677; U.S. Pat. No. 5,683,336; U.S. Pat. No. 4,993,705; U.S. Pat. No. 2,097,376; and U.S. Pat. No. Des. 360,440.

While these devices fulfill their respective, particular objectives and requirements, the aforementioned patents do not disclose a new exercise apparatus utilizing elastic straps. The inventive device includes a body harness that is adapted for extending across a back and a pair of shoulders of a user. The body harness has a T-shaped portion to help hold the body harness in place. The T-shaped portion is adapted for extending downwardly from the body harness along the back of the user. The T-shaped portion having a pair of horizontal torso straps which are adapted for adjustable extension around the torso of a user. A set of arm bands has a pair of upper arm bands and a pair of wrist bands. The upper arm bands and the wrist bands are connected by a plurality of resiliently elastic arm resistance straps. The pair of upper arm bands is coupled to the body harness. Each of the upper arm bands is adapted for adjustably wrapping around an upper arm towards a shoulder of the user. The par of wrist bands are adapted for extension around wrists of the user.

In these respects, the exercise apparatus utilizing elastic straps according to the present invention substantially departs from the conventional concepts and designs of the prior art, and in so doing provides an apparatus primarily developed for the purpose of providing resistance to muscles of the body.

SUMMARY OF THE INVENTION

In view of the foregoing disadvantages inherent in the known types of exercise apparatuses now present in the prior art, the present invention provides a new exercise apparatus utilizing elastic straps construction wherein the same can be utilized for providing resistance to muscles of the body.

The general purpose of the present invention, which will be described subsequently in greater detail, is to provide a new exercise apparatus utilizing elastic straps apparatus and method which has many of the advantages of the exercise apparatuses mentioned heretofore and many novel features that result in a new exercise apparatus utilizing elastic straps which is not anticipated, rendered obvious, suggested, or even implied by any of the prior art exercise apparatuses, either alone or in any combination thereof.

To attain this, the present invention generally comprises a body harness that is adapted for extending across a back and a pair of shoulders of a user. The body harness has a T-shaped portion to help hold the body harness in place. The T-shaped portion is adapted for extending downwardly from the body harness along the back of the user. The T-shaped portion having a pair of horizontal torso straps which are adapted for adjustable extension around the torso of a user. A set of arm bands has a pair of upper arm bands and a pair of wrist bands. The upper arm bands and the wrist bands are connected by a plurality of resiliently elastic arm resistance straps. The pair of upper arm bands is coupled to the body harness. Each of the upper arm bands is adapted for adjustably wrapping around an upper arm towards a shoulder of the user. The pair of wrist bands are adapted for extension around wrists of the user.

There has thus been outlined, rather broadly, the more important features of the invention in order that the detailed description thereof that follows may be better understood, and in order that the present contribution to the art may be better appreciated. There are additional features of the invention that will be described hereinafter and which will form the subject matter of the claims appended hereto.

In this respect, before explaining at least one embodiment of the invention in detail, it is to be understood that the invention is not limited in its application to the details of construction and to the arrangements of the components set forth in the following description or illustrated in the drawings. The invention is capable of other embodiments and of being practiced and carried out in various ways. Also, it is to be understood that the phraseology and terminology employed herein are for the purpose of description and should not be regarded as limiting.

As such, those skilled in the art will appreciate that the conception, upon which this disclosure is based, may readily be utilized as a basis for the designing of other structures, methods and systems for carrying out the several purposes of the present invention. It is important, therefore, that the claims be regarded as including such equivalent constructions insofar as they do not depart from the spirit and scope of the present invention.

Further, the purpose of the foregoing abstract is to enable the U.S. Patent and Trademark Office and the public generally, and especially the scientists, engineers and practitioners in the art who are not familiar with patent or legal terms or phraseology, to determine quickly from a cursory inspection the nature and essence of the technical disclosure of the application. The abstract is neither intended to define the invention of the application, which is measured by the claims nor is it intended to be limiting as to the scope of the invention in any way.

It is therefore an object of the present invention to provide a new exercise apparatus utilizing elastic straps apparatus and method which has many of the advantages of the exercise apparatuses mentioned heretofore and many novel features that result in a new exercise apparatus utilizing elastic straps which is not anticipated, rendered obvious, suggested, or even implied by any of the prior art exercise apparatuses, either alone or in any combination thereof.

It is another object of the present invention to provide a new exercise apparatus utilizing elastic straps which may be easily and efficiently manufactured and marketed.

It is a further object of the present invention to provide a new exercise apparatus utilizing elastic straps which is of a durable and reliable construction.

An even further object of the present invention is to provide a new exercise apparatus utilizing elastic straps which is susceptible of a low cost of manufacture with regard to both materials and labor, and which accordingly is then susceptible of low prices of sale to the consuming public, thereby making such exercise apparatus utilizing elastic straps economically available to the buying public.

Still yet another object of the present invention is to provide a new exercise apparatus utilizing elastic straps which provides in the apparatuses and methods of the prior art some of the advantages thereof, while simultaneously overcoming some of the disadvantages normally associated therewith.

Still another object of the present invention is to provide a new exercise apparatus utilizing elastic straps for providing resistance to muscles of the body.

Yet another object of the present invention is to provide a new exercise apparatus utilizing elastic straps which includes a body harness that is adapted for extending across a back and a pair of shoulders of a user. The body harness has a T-shaped portion to help hold the body harness in place. The T-shaped portion is adapted for extending downwardly from the body harness along the back of the user. The T-shaped portion having a pair of horizontal torso straps which are adapted for adjustable extension around the torso of a user. A set of arm bands has a pair of upper arm bands and a pair of wrist bands. The upper arm bands and the wrist bands are connected by a plurality of resiliently elastic arm resistance straps. The pair of upper arm bands is coupled to the body harness. Each of the upper arm bands is adapted for adjustably wrapping around an upper arm towards a shoulder of the user. The pair of wrist bands are adapted for extension around wrists of the user.

Still yet another object of the present invention is to provide a new exercise apparatus that may be worn under clothing.

Even still another object of the present invention is to provide a new exercise apparatus that may be worn while swimming.

Even still yet another object of the present invention is to provide a new exercise apparatus utilizing elastic straps that improves a martial artist's or boxer's power and endurance.

These together with other objects of the invention, along with the various features of novelty which characterize the invention, are pointed out with particularity in the claims annexed to and forming a part of this disclosure. For a better understanding of the invention, its operating advantages and the specific objects attained by its uses, reference should be made to the accompanying drawings and descriptive matter in which there are illustrated preferred embodiments of the invention.

BRIEF DESCRIPTION OF THE DRAWINGS

The invention will be better understood and objects other than those set forth above will become apparent when consideration is given to the following detailed description thereof. Such description makes reference to the annexed drawings wherein.

DESCRIPTION OF THE PREFERRED EMBODIMENT

Figure 1:
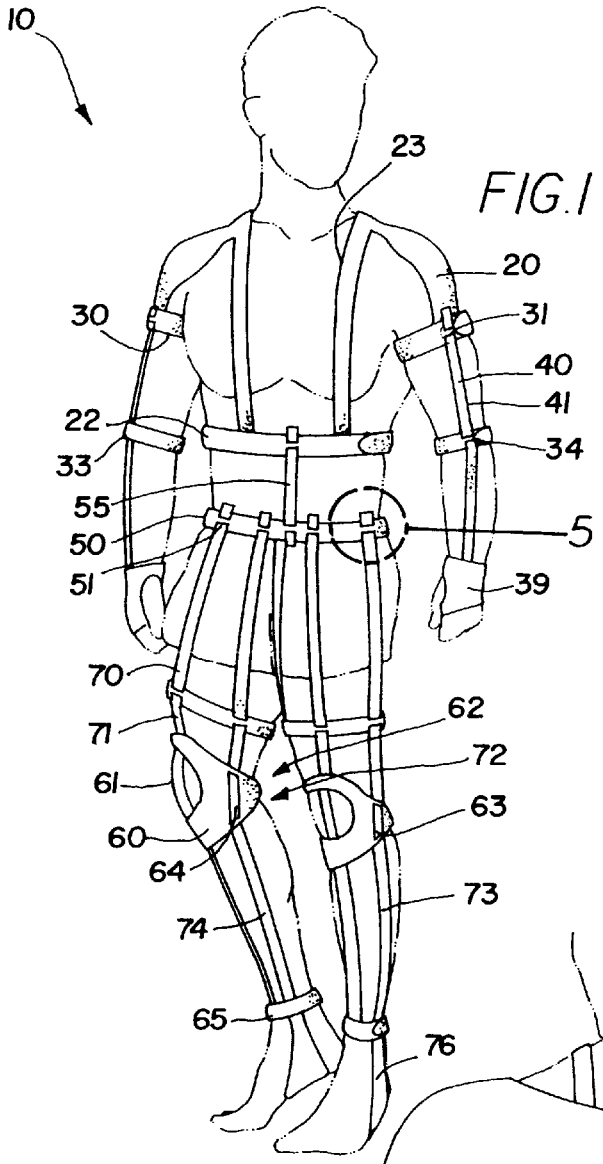
FIG. 1 is a schematic perspective view of a new exercise apparatus utilizing elastic straps according to the present invention.
Figure 2:
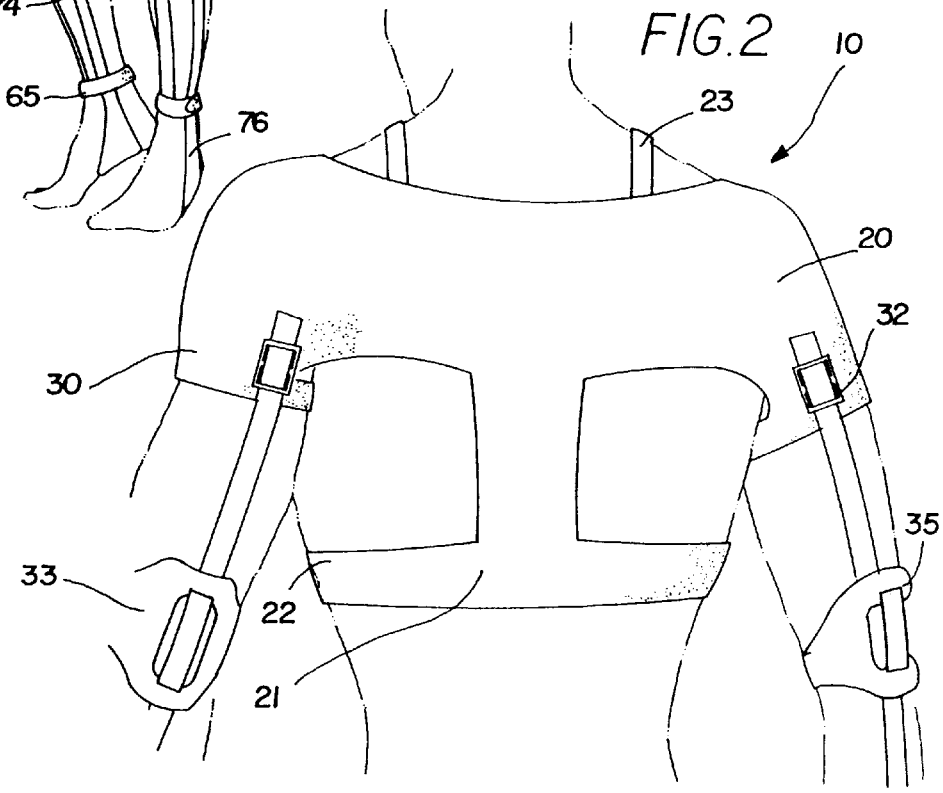
FIG. 2 is a partial view of the present invention.

With reference now to the drawings, and in particular to FIGS. 1 through 5 thereof, a new exercise apparatus utilizing elastic straps embodying the principles and concepts of the present invention and generally designated by the reference numeral 10 will be described.

As best illustrated in FIGS. 1 through 5, the exercise apparatus 10 comprises a body harness 20 that is adapted for extending across a back and a pair of shoulders of a user. The body harness 20 has a T-shaped portion 21 to help hold the body harness 20 in place. The T-shaped portion 21 is adapted for extending downwardly from the body harness 20 along the back of the user. The T-shaped portion 21 has a pair of horizontal torso straps 22 which are adapted for adjustable extension around the torso of a user. A set of arm bands has a pair of upper arm bands 30 and a pair of wrist bands 36. The pair of upper arm bands 30 is coupled to the body harness 20. Each of the upper arm bands 30 is adapted for adjustably wrapping around an upper arm towards a shoulder of the user. The pair of wrist bands 36 are adapted for extension around wrists of the user. The upper arm bands 30 and the wrist bands 36 are connected by a plurality of resiliently elastic arm resistance straps 40.

Preferably, the body harness 20 comprises leather to provide durability and comfort. Also preferably, a pair of shoulder straps 23 extend across the chest of a user between the body harness 20 and the torso straps 22 to help hold the body harness 20 in place.

Preferably, the set of arm bands includes a pair of elbow bands 33. The elbow bands 33 are connected to the upper arm bands 30 and the wrist bands 36 by the arm resistance straps 40. The pair of elbow bands 33 is adapted for adjustably wrapping around elbows of a user.

Means of permitting adjustable wrapping can include hooks and loops fasteners, snaps, or any other suitable means.

Also preferably, each of the upper arm bands 30 has a front upper arm slot 31 and a back upper arm slot 32 extending therethrough. Each of the wrist bands 36 has a front wrist slot 37 and a back wrist slot 38 extending therethrough. Each of the elbow bands 33 has a front elbow slot 34 and a back elbow slot 35 extending therethrough.

Preferably, the plurality of arm resistance straps 40 comprise a pair of front arm straps 41 and a pair of back arm straps 42. The front arm straps 41 extend along fronts of the arms of the user from the upper arm bands 30 to the wrist bands 36. Ideally, the front arm straps 41 are adjustably coupled to the front upper arm slots 31 of the upper arm bands 30. The front arm straps 41 are also adjustably coupled to the front wrist slots 37 of the wrist bands 36. Means of adjustable coupling can include hooks and loops fasteners, snaps, or any other suitable means. The front arm straps 41 are slidably inserted in the front elbow slots 34 of the elbow bands 33.

The back arm straps 42 extend along backs of the arms of the user from the upper arm bands 30 to the wrist bands 36. Ideally, the back arm straps 42 are adjustably coupled to the back upper arm slots 32 of the upper arm bands 30. The back arm straps 42 are also adjustably coupled to the back wrist slots 38 of the wrist bands 36. The back arm straps 42 are slidably inserted in the back elbow slots 35 of the elbow bands 33.

Figure 3:
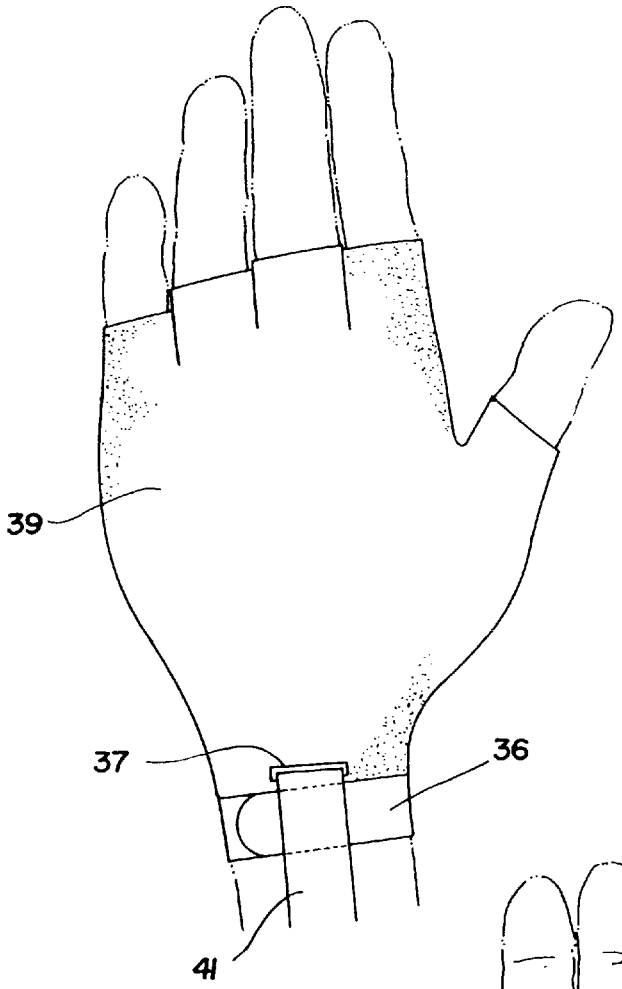
FIG. 3 is a detailed view of the present invention.
Figure 4:
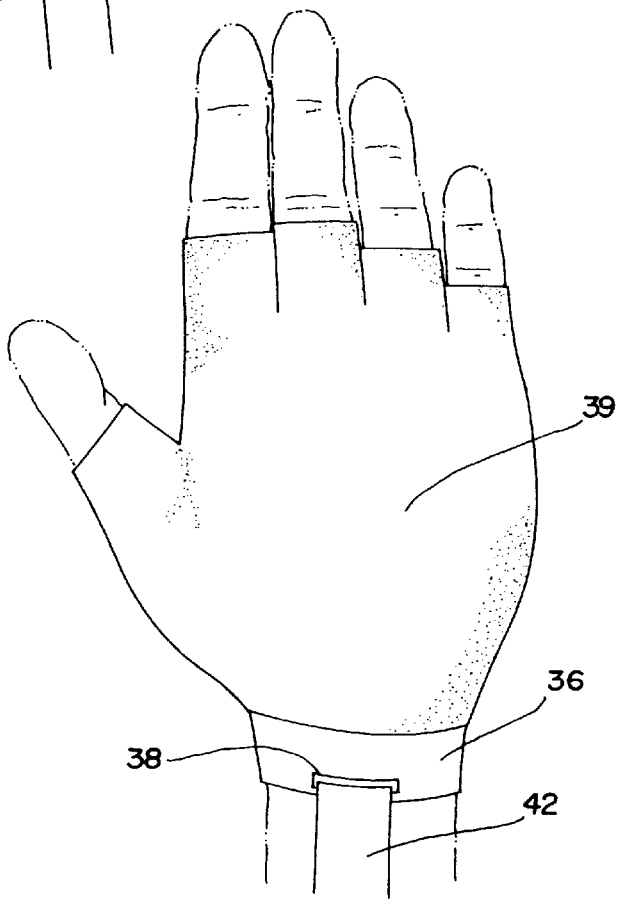
FIG. 4 is a detailed view of the present invention.
Figure 5:
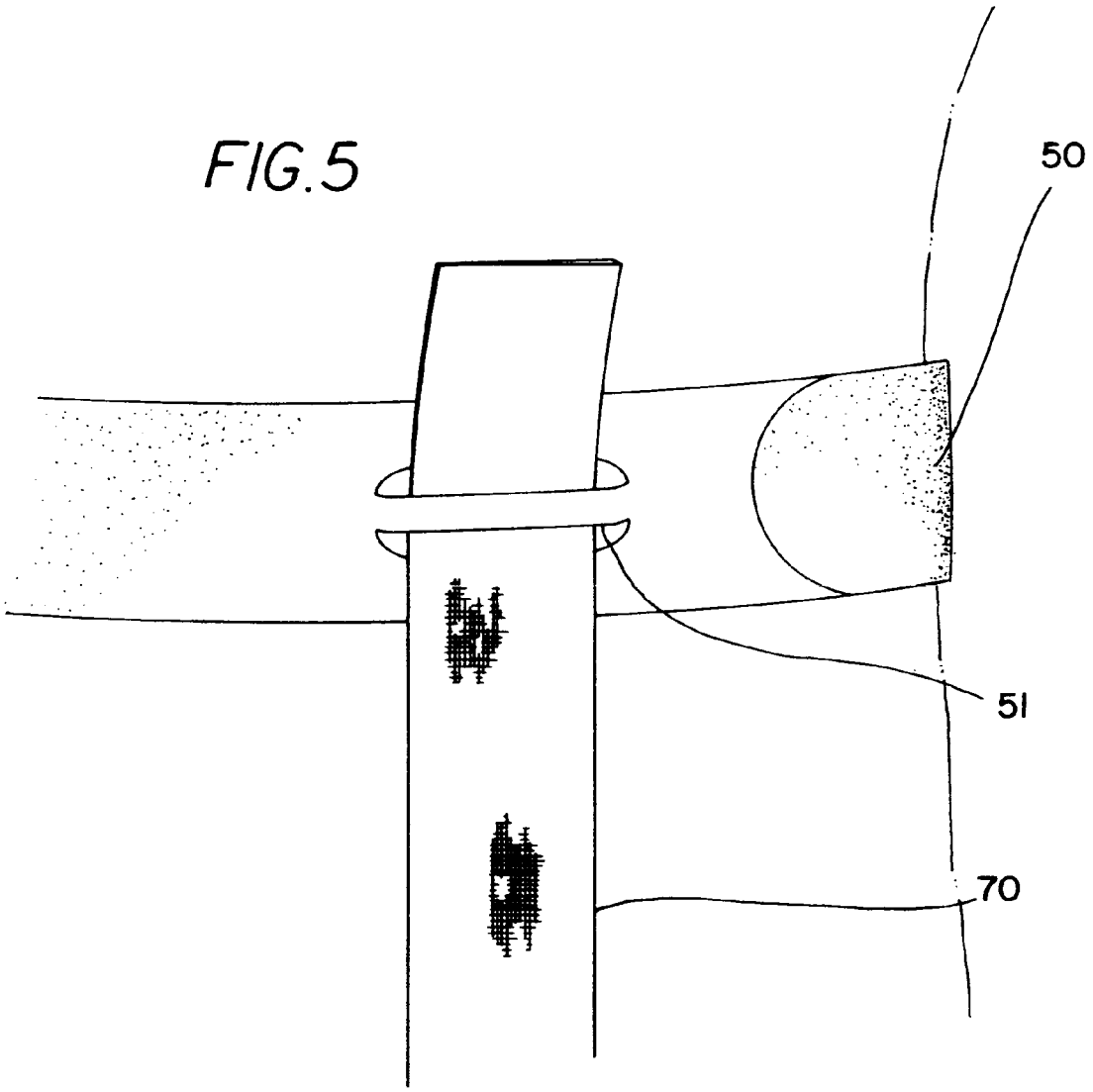
FIG. 5 is a detailed view of the present invention.

Ideally, as shown in FIGS. 3 and 4, each of the wrist bands 36 has a glove portion 39 that extends around a hand of a user.

Preferably, the inventive device also includes a portion for exercising the muscles of the lower body. In such an embodiment, a waist band 50 is adapted for adjustable extension around the waist of a user.

A set of leg bands has a pair of knee bands 60 and a pair of ankle bands 65. Each of the knee bands 60 is adapted for adjustably wrapping around a knee of a user. Each of the ankle bands 65 is adapted for adjustably wrapping around an ankle of a user. The waist band 50, the knee bands 60, and the ankle bands 65 are coupled together by a plurality of resiliently elastic leg resistance straps 70.

More preferably, the waist band 50 has a plurality of waist slots 51 extending therethrough. Each of the knee bands 60 has a front knee slot 61, a rear knee slot 62, an outer knee slot 63, and an inner knee slot 64 extending therethrough.

Preferably, the plurality of leg resistance straps 70 comprises a pair of front leg straps 71, a pair of rear leg straps 72, a pair of outer leg straps 73, and a pair of inner leg straps 74.

The front leg straps 71 extend along fronts of the legs of a user from the waist band 50 to the ankle bands 65. Ideally, the front leg straps 71 are adjustably coupled to a pair of waist slots 51 of the waist band 50 and are slidably inserted in the front knee slots 61 of the knee bands 60.

The rear leg straps 72 extend along backs of the legs of a user from the waist band 50 to the ankle bands 65. Ideally, the rear leg straps 72 are adjustably coupled to another pair of waist slots 51 of the waist band 50 and are slidably inserted in the rear knee slots 62 of the knee bands 60.

The outer leg straps 73 extend along an outer side of the legs of a user from the waist band 50 to the ankle bands 65. Ideally, the outer leg straps 73 are adjustably coupled to another pair of waist slots 51 of the waist band 50 and are slidably inserted in the outer knee slots 63 of the knee bands 60.

The inner leg straps 74 extend along an inner side of the legs of a user from the waist band 50 to the ankle bands 65. Ideally, the inner leg straps 74 are adjustably coupled to the waist slots 51 of the waist band 50 and are slidably inserted in the inner knee slots 64 of the knee bands 60.

Ideally, a pair of foot straps 76 for keeping the ankle straps from sliding up the leg are adapted for extension around the foot of a user. Each of the foot straps 76 is coupled to an associated ankle band 65.

Also ideally, an attachment strap 55 extends between the waist band 50 and the torso straps 22 to hold them together. The attachment strap is releasably coupled to the torso straps 22 and is releasably coupled to the waist band 50. More ideally, the attachment strap 55 is resiliently elastic. Most ideally, a plurality of attachment straps extend between the waist band 50 and the torso straps 22.

In use, the body harness 20 is placed across the back of the user. The torso straps 22 are wrapped around the torso of the wearer. The arm bands 30, 33, 36 are wrapped around the associated parts of the arms of the user. The tension of the arm resistance straps 40 is adjusted by coupling the arm resistance straps 40 to the upper arm slots 31, 32 and wrist slots 37, 38 such that a desired amount of resistance to movement of the arms is provided by the arm resistance straps 40. The user moves the arms back and forth against the resistance, such as by shadow boxing or striking a punching bag. The arm resistance straps 40 are permitted to slide back and forth through the elbow slots 34, 35.

If exercise of the legs is desired, the waist band 50 is wrapped around the waist of the user. The knee bands 60 and ankle bands 65 are wrapped around the legs of the user. The tension of the leg resistance straps 70 is adjusted by coupling the leg resistance straps 70 to the waist slots 51 of the waist band 50 such that a desired amount of resistance to movement of the legs is provided by the leg resistance straps 70. The user moves the legs back and forth against the resistance, such as by walking, running, or performing martial arts movements. The leg resistance straps 70 are permitted to slide back and forth through the knee slots 61, 62, 63, 64.

The waist and leg bands 50, 60, 65 may be worn together with or separate from the portion of the exercise apparatus 10 that exercises the upper body. If worn together, the attachment strap 55 may be coupled to the torso straps 22 and the waist band 50.

As to a further discussion of the manner of usage and operation of the present invention, the same should be apparent from the above description. Accordingly, no further discussion relating to the manner of usage and operation will be provided.

With respect to the above description then, it is to be realized that the optimum dimensional relationships for the parts of the invention, to include variations in size, materials, shape, form, function and manner of operation, assembly and use, are deemed readily apparent and obvious to one skilled in the art, and all equivalent relationships to those illustrated in the drawings and described in the specification are intended to be encompassed by the present invention.

Therefore, the foregoing is considered as illustrative only of the principles of the invention. Further, since numerous modifications and changes will readily occur to those skilled in the art, it is not desired to limit the invention to the exact construction and operation shown and described, and accordingly, all suitable modifications and equivalents may be resorted to, falling within the scope of the invention.

We claim:

1. An exercise apparatus for providing resistance to muscles of the body, the exercise apparatus comprising:

a body harness being adapted for extending across a back and a pair of shoulders of a user;

said body harness having a T-shaped portion adapted for extending downwardly from said body harness along the back of the user, the T-shaped portion having a pair of horizontal torso straps, said torso straps being adapted for adjustable extension around the torso of a user;

a set of arm bands having a pair of upper arm bands and a pair of wrist bands, said upper arm bands and said wrist bands being connected by a plurality of resiliently elastic arm resistance straps;

said pair of upper arm bands being coupled to said body harness, each of said upper arm bands being adapted for wrapping around an upper arm towards a shoulder of the user; and said pair of wrist bands being adapted for extension around wrists of the user;

a waist band and a set of leg bands, said waist band being adapted for adjustable extension around the waist of a user, a set of leg bands having a pair of knee bands and a pair of ankle bands, said waist band, said knee bands, and said ankle bands being coupled together by a plurality of resiliently elastic leg resistance straps, each of said knee bands being adapted for wrapping around a knee of a user, each of said ankle bands being adapted for wrapping around an ankle of a user; and an attachment strap being extended between said waist band and said torso straps, said attachment strap being releasably coupled to said torso straps, said attachment strap being releasably coupled to said waist band.

2. The exercise apparatus of claim 1, further comprising a pair of elbow bands, said elbow bands being connected to said wrist bands and said upper arm bands by said arm resistance straps, said elbow bands being adapted for wrapping around elbows of a user.

3. The exercise apparatus of claim 2, wherein said plurality of arm resistance straps comprises a pair of front arm straps and a pair of aback arm straps, said front arm straps being extended along fronts of the arms of the user from said upper arm bands to said wrist bands, said back arm straps being extended along backs of the arms of the user from said upper arm bands to said wrist bands.

4. An exercise apparatus for providing resistance to muscles of the body, the exercise apparatus comprising:

a body harness being adapted for extending across a back and a pair of shoulders of a user;

said body harness having a T-shaped portion adapted for extending downwardly from said body harness along the back of the user, the T-shaped portion having a pair of horizontal torso straps, said torso straps being adapted for adjustable extension around the torso of a user;

a set of arm bands having a pair of upper arm bands and a pair of wrist bands, said upper arm bands and said wrist bands being connected by a plurality of resiliently elastic arm resistance straps;

said pair of upper arm bands being coupled to said body harness, each of said upper arm bands being adapted for wrapping around an upper arm towards a shoulder of the user;

said pair of wrist bands being adapted for extension around wrists of the user;

a pair of elbow bands, said elbow bands being connected to said wrist bands and said upper arm bands by said arm resistance straps, said elbow bands being adapted for wrapping around elbows of a user;

wherein said plurality of arm straps comprises a pair of front arm straps and a pair of back arm straps, said front arm straps being extended along fronts of the arms of the user from said upper arm bands to said wrist bands, said back arm straps being extended along backs of the arms of the user from said upper arm bands to said wrist bands; and wherein each of said upper arm bands has a front upper arm slot and a back upper arm slot extending therethrough, each of said elbow bands having a front elbow slot and a back elbow slot extending therethrough, each of said wrist bands having a front wrist slot and a back wrist slot extending therethrough.

5. The exercise apparatus of claim 4, wherein said front arm straps are adjustably coupled to said front upper arm slots of said upper arm bands, said front arm straps being adjustably coupled to said front wrist slots of said wrist bands, said front arm straps being slidably inserted in said front elbow slots of said elbow bands, said back arm straps being adjustably coupled to said back upper arm slots of said upper arm bands, said back arm straps being adjustably coupled to said back wrist slots of said wrist bands, said back arm straps being slidably inserted in said back elbow slots of said elbow bands.

6. The exercise apparatus of claim 1, wherein each of said wrist bands has a glove portion for extending around a hand of a user.

7. The exercise apparatus of claim 1, wherein said plurality of leg resistance straps comprises a pair of front leg straps, a pair of rear leg straps, said front leg straps being extended along fronts of the legs of a user from said waist band to said ankle bands, said rear leg straps being extended along backs of the legs of a user from said waist band to said ankle bands.

8. The exercise apparatus of claim 7, wherein said waist band has a plurality of waist slots extending therethrough, each of said knee bands having a front knee slot and a rear knee slot extending therethrough, said front leg straps being adjustably coupled to a pair of waist slots of said waist band, said front leg straps being slidably inserted in said front knee slots of said knee bands, said rear leg straps being adjustably coupled to another pair of waist slots of said waist band, said rear leg straps being slidably inserted in said rear knee slots of said knee bands.

9. The exercise apparatus of claim 7, wherein said plurality of leg resistance straps further comprises a pair of outer leg straps and a pair of inner leg straps, said outer leg straps being extended along an outer side of the legs of a user from said waist band to said ankle bands, said inner leg straps being extended along an inner side of the legs of a user from said waist band to said ankle bands.

10. The exercise apparatus of claim 9, wherein said waist band has a plurality of waist slots extending therethrough, each of said knee bands having a outer knee slot and a inner knee slot extending therethrough, said outer leg straps being adjustably coupled to a pair of waist slots of said waist band, said outer leg straps being slidably inserted in said outer knee slots of said knee bands, said inner leg straps being adjustably coupled to another pair of waist slots of said waist band, said inner leg straps being slidably inserted in said inner knee slots of said knee bands.

11. The exercise apparatus of claim 1, further comprising a pair of foot straps being adapted for extension around the foot of a user, each of said foot straps being coupled to an associated ankle band.

12. The exercise apparatus of claim 1, further comprising a pair of shoulder straps adapted for extending across the chest of a user between said body harness and said torso straps.

13. An exercise apparatus for providing resistance to muscles of the body, the exercise apparatus comprising:

a body harness being adapted for extending across a back and a pair of shoulders of a user;

said body harness having a T-shaped portion adapted for extending downwardly from said body harness along the back of the user, the T-shaped portion having a pair of horizontal torso straps, said torso straps being adapted for adjustable extension around the torso of a user;

a pair of shoulder straps adapted for extending across the chest of a user between said body harness and said torso straps;

a set of arm bands having a pair of upper arm bands, a pair of elbow bands, and a pair of wrist bands, said upper arm bands, said elbow bands, and said wrist bands being connected by a plurality of resiliently elastic arm resistance straps;

said pair of upper arm bands being coupled to said body harness, each of said upper arm bands being adapted for wrapping around an upper arm towards a shoulder of the user, each of said upper arm bands having a front upper arm slot and a back upper arm slot extending therethrough;

said pair of elbow bands being adapted for wrapping around elbows of a user, each of said elbow bands having a front elbow slot and a back elbow slot extending therethrough;

said pair of wrist bands being adapted for extension around wrists of the user, each of said wrist bands having a front wrist slot and a back wrist slot extending therethrough;

said plurality of arm resistance straps comprising a pair of front arm straps and a pair of back arm straps;

said front arm straps being extended along fronts of the arms of the user from said front upper arm slots of said upper arm bands to said front wrist slots of said wrist bands;

said front arm straps being adjustably coupled to said front upper arm slots of said upper arm bands, said front arm straps being adjustably coupled to said front wrist slots of said wrist bands, said front arm straps being slidably inserted in said front elbow slots of said elbow bands;

said back arm straps being extended along backs of the arms of the user from said back upper arm slots of said upper arm bands to said back wrist slots of said wrist bands;

said back arm straps being adjustably coupled to said back upper arm slots of said upper arm bands, said back arm straps being adjustably coupled to said back wrist slots of said wrist bands, said back arm straps being slidably inserted in said back elbow slots of said elbow bands;

each of said wrist bands having a glove portion for extending around a hand of a user;

a waist band being adapted for adjustable extension around the waist of a user, said waist band having a plurality of waist slots extending therethrough;

a set of leg bands having a pair of knee bands and a pair of ankle bands, said waist band, said knee bands, and said ankle bands being coupled together by a plurality of resiliently elastic leg resistance straps;

each of said knee bands being adapted for wrapping around a knee of a user, each of said knee bands having a front knee slot, a rear knee slot, an outer knee slot, and an inner knee slot extending therethrough;

each of said ankle bands being adapted for wrapping around an ankle of a user;

said plurality of leg resistance straps comprising a pair of front leg straps, a pair of rear leg straps, a pair of outer leg straps, and a pair of inner leg straps;

said front leg straps being extended along fronts of the legs of a user from two of said waist slots of said waist band to said ankle bands;

said front leg straps being adjustably coupled to said waist slots of said waist band, said front leg straps being slidably inserted in said front knee slots of said knee bands;

said rear leg straps being extended along backs of the legs of a user from another pair of said waist slots of said waist band to said ankle bands;

said rear leg straps being adjustably coupled to said waist slots of said waist band, said rear leg straps being slidably inserted in said rear knee slots of said knee bands;

said outer leg straps being extended along an outer side of the legs of a user from another pair of said waist slots of said waist band to said ankle bands;

said outer leg straps being adjustably coupled to said waist slots of said waist band, said outer leg straps being slidably inserted in said outer knee slots of said knee bands;

said inner leg straps being extended along an inner side of the legs of a user from another pair of said waist slots of said waist band to said ankle bands;

said inner leg straps being adjustably coupled to said waist slots of said waist band, said inner leg straps being slidably inserted in said inner knee slots of said knee bands;

a pair of foot straps being adapted for extension around the foot of a user, each of said foot straps being coupled to an associated/ankle band; and an attachment strap being extended between said waist band and said torso straps, said attachment strap being releasably coupled to said torso straps, said attachment strap being releasably coupled to said waist band.

14. The exercise apparatus of claim 4, wherein each of said wrist bands has a glove portion for extending around a hand of a user.

15. The exercise apparatus of claim 4, further comprising a waist band and a set of leg bands, said waist band being adapted for adjustable extension around the waist of a user, a set of leg bands having a pair of knee bands and a pair of ankle bands, said waist band, said knee bands, and said ankle bands being coupled together by a plurality of resiliently elastic leg resistance straps, each of said knee bands being adapted for wrapping around a knee of a user, each of said ankle bands being adapted for wrapping around an ankle of a user.

16. The exercise apparatus of claim 15, wherein said plurality of leg resistance straps comprises a pair of front leg straps, a pair of rear leg straps, said front leg straps being extended along fronts of the legs of a user from said waist band to said ankle bands, said rear leg straps being extended along backs of the legs of a user from said waist band to said ankle bands, and wherein said waist band has a plurality of waist slots extending therethrough, each of said knee bands having a front knee slot and a rear knee slot extending thereghrough, said front leg straps being adjustably coupled to a pair of waist slots of said waist band, said front leg straps being slidably inserted in said front knee slots of said knee bands, said rear leg straps being adjustably coupled to another pair of waist slots of said waist band, said rear leg straps being slidably inserted in said rear knee slots of said knee bands.

17. The exercise apparatus of claim 15, wherein said plurality of leg resistance straps comprises a pair of front leg straps, a pair of rear leg straps, said front leg straps being extended along fronts of the legs of a user from said waist band to said ankle bands, said rear leg straps being extended along backs of the legs of a user from said waist band to said ankle bands, and wherein said plurality of leg resistance straps further comprises a pair of outer leg straps and a pair of inner leg straps, said outer leg straps being extended along an outer side of the legs of a user from said waist band to said ankle bands, said inner leg straps being extended along an inner side of the legs of a user from said waist band to said ankle bands, and wherein said waist band has a plurality of waist slots extending therethrough, each of said knee bands having a outer knee slot and a inner knee slot extending therethrough, said outer leg straps being adjustably coupled to a pair of waist slots of said waist band, said outer leg straps being slidably inserted in said outer knee slots of said knee bands, said inner leg straps being adjustably coupled to another pair of waist slots of said waist band, said inner leg straps being slidably inserted in said inner knee slots of said knee bands.

18. The exercise apparatus of claim 15, further comprising an attachment strap being extended between said waist band and said torso straps, said attachment strap being releasably coupled to said torso straps, said attachment strap being releasably coupled to said waist band.

* * * * *